United States Patent [19]

Sawa et al.

[11] Patent Number: 4,859,256

[45] Date of Patent: Aug. 22, 1989

[54] HIGH PERMEABILITY AMORPHOUS MAGNETIC MATERIAL

[75] Inventors: Takao Sawa, Yokohama; Susumu Hashimoto, Oota; Koichiro Inomata, Yokohama, all of Japan

[73] Assignee: Kabushiki Kaisha Toshiba, Kawasaki, Japan

[21] Appl. No.: 9,373

[22] Filed: Jan. 30, 1987

[30] Foreign Application Priority Data

Feb. 24, 1986 [JP] Japan ..... 61-37374
Sep. 17, 1986 [JP] Japan ..... 61-217110

[51] Int. Cl.[4] ..... H01F 1/04

[52] U.S. Cl. ..... 148/304; 148/403; 428/606

[58] Field of Search ..... 148/304, 403; 428/606

[56] References Cited

U.S. PATENT DOCUMENTS 4,411,716 10/1983 Shiiki et al. ..... 148/304
4,464,208 8/1984 Tateishi ..... 148/403
4,473,415 9/1984 Ochiai et al. ..... 148/304
4,473,417 9/1984 Inomata et al. ..... 428/606
4,504,327 3/1985 Inomata et al. ..... 148/304
4,517,017 5/1985 Inomata et al. ..... 148/403
4,637,843 1/1987 Takayama et al. ..... 148/403

FOREIGN PATENT DOCUMENTS 145245 6/1985 European Pat. Off. .
51-73923 6/1976 Japan .
52-138430 11/1977 Japan .

OTHER PUBLICATIONS

Tech. Mitt. Krupp Forsh.-Ber-Band 40 (1982) H., pp. 67-71, by W. Jaschinski.

J. Appl. Phys. 51(8), Aug. 1980, by Kohmoto et al., pp. 4342-4345.

*Primary Examiner*—John P. Sheehan

*Attorney, Agent, or Firm*—Foley & Lardner, Schwartz, Jeffery, Schwaab, Mack, Blumenthal & Evans

[57] ABSTRACT

To obtain a high permeability magnetic core, the core is made of a 5 to 25 μm thick ribbon of a Co-based amorphous alloy with a Curie temperature Tc between 120° C. and 270° C., and further heat treated at a temperature below Tc within a magnetic field (1 Oe or more) applied in the lateral direction of the thin ribbon. Further, the saturation magnetostriction constant of the ribbon should be $-2$ to $1\times10^{-6}$.

7 Claims, 3 Drawing Sheets

HIGH PERMEABILITY AMORPHOUS MAGNETIC MATERIAL

BACKGROUND OF THE INVENTION

1. Field of the Invention

The present invention relates to a method of manufacturing high permeability magnetic cores usable for noise filters, zero-phase current transformers, magnetic heads, saturable reactor, small-sized spike noise reducing inductor, etc. which require a higher permeability material.

2. Description of the Prior Art

A higher performance has recently been required for magnetic parts in proportion to the higher performance of electronic devices. Accordingly, excellent magnetic characteristics have been required for magnetic materials used for these magnetic parts. A high permeability material is effective to various magnetic parts of current sensors such as zero-phase current transformes, noise filters, etc.

The magnetic material used for a noise filter will be described hereinbelow by way of example.

A switching power supply is widely used as a stable power supply for computer peripheral devices or general communication systems. In the switching power supply, noise voltage is often generated in the device being superimposed upon the power supply voltage when the supply voltage is applied from an external power supply line. In addition, there exists another problem such that higher noises (with the switching frequency as the fundamental frequency) or noises on the order of MHz generated from a load such as logical circuits incorporated in a computer will be generated and inputted to the device.

In order to reduce these conductive noises, a common mode choke coil for reducing noise between a device and the ground as shown in FIG. 1 is often used as a noise filter. In FIG. 1, a pair of windings 3*a*, 3*b* are wound around a magnetic core 2 in such a way that two magnetic fluxes each generated by an alternating current passed through the winding can be cancelled out each other. Further, capacitors 4*a*, 4*b* and 4*c* are connected between these windings 3*a* and 3*b*, and a junction point between the two 4*b* and 4*c* is gounded.

When the filter as described above is connected to the power supply line, the ratio of noise output voltage to noise input voltage is closely related to the permeability of the magnetic core of the filter, in other words, the higher the permeability is, the smaller will be the noise output voltage. Further, excellent frequency characteristics of the permeability are also required because the filter should function effectively even at a high frequency range of 1 MHz or more in addition to a low frequency range.

Conventionally, ferrite has been used as material for manufacturing the magnetic core of the common mode choke coil. However, recently, since there exists a strong demand for noise reduction even at a relatively low frequency range of 10 to 450 kHz, a problem arises in that ferrite cannot sufficiently reduce low frequency noise because the permeability of ferrite is relatively low at low frequencies. Therefore, magnetic core materials provided with a higher permeability at low frequency range and stable frequency characteristics have strongly been needed.

On the other hand, recently, the availableness of amorphous alloys for the common mode choke coil has been studied because of its higher permeability. However, the amorphous alloys are not yet satisfactory with respect to the noise level reduction at lower frequencies, and further the researches for higher permeability amorphous alloys may reach a limit for the future if only the alloy composition will be studied.

In the magnetic core for noise filters, a high permeability is required over a wide frequency range. Further, a higher permeability contributes to the miniaturization, the higher precision, and the higher sensitivity of apparatus including magnetic cores. Therefore, there exists a strong demand for higher permeability material available for magnetic apparatuses.

SUMMARY OF THE INVENTION

With problems in mind, therefore, it is the primary object of the present invention to provide a method of manufacturing a high permeability magnetic core.

To achieve the above-mentioned object, the method of manufacturing a high permeability magnetic core according to the present invention comprises the following steps of: (a) preparing a magnetic core made of a Co-based amorphous alloy ribbon having a Curie temperature Tc of 120° C.≦Tc≦270° C. and (b) heat treating the prepared magnetic core at a temperature lower than the Curie temperature within a magnetic field applied transverse to the ribbon axis.

In the first aspect of the present invention, the above Co-based amorphous alloy is expressed as $$(Co_{1-a-b}Fe_aM_b)_{100-z}(Si_{1-y}B_y)_z$$

where M denotes at least one of Ti, V, Cr, Mn, Ni, Cu, Zr, Nb, Mo, Hf, Ta, W and platinum group metal, and a, b, y and z are constants expressed by atomic ratio as $$0.02 \leqq a \leqq 0.08$$

$$0 \leqq b \leqq 0.04$$

$$0.3 \leqq y \leqq 0.5$$

$$25 \leqq z \leqq 32.$$

In the second aspect of the present invention, the above Co-based amorphous alloy is expressed as $$(Co_{1-a}Fe_a)_{100-z}(Si_{1-y}B_y)_z$$

$$0.02 \leqq a \leqq 0.08$$

$$25 \leqq z \leqq 32.$$

In the present invention, the magnitude of saturation magnetostriction constant λs of the alloy is a very important factor and should preferably be within a range from $-2$ to $1\times10^{-6}$ in absolute value. The saturation magnetostriction constant is mainly dependent upon the atomic ratio of Fe.

The intensity of the applied magnetic field is 1 Oe or more and preferably 10 Oe or more. Further, the thickness of the thin ribbon is 5 to 25 μm.

BRIEF DESCRIPTION OF THE DRAWINGS

The features and advantages of the method of manufacturing high permeability magnetic core according to the present invention will be more clearly appreciated from the following description taken in conjunction with the accompanying drawings in which.

DETAILED DESCRIPTION OF THE PREFERRED EMBODIMENTS

Figure 1:
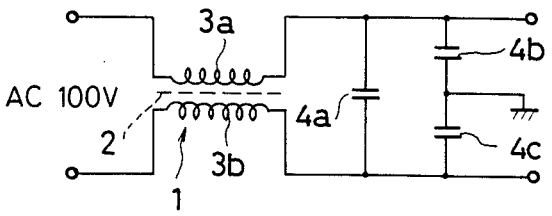
FIG. 1 is a circuit diagram of a common mode choke coil for assistance in explaining a magnetic core to which the method according to the present invention can be applied.

To obtain high permeability materials, the inventors have studied various materials from the standpoints of compositions, heat treatments or other factors, and have found that it is possible to obtain a peculiarly high permeability when a ribbon magnetic core made of a Co-based amorphous alloy with a Curie temperature from 120° to 270° C., preferably from 220° to 250° C. is heat treated at a temperature lower than the Curie temperature within a magnetic field applied transverse to the ribbon axis.

The used amorphous alloys are Co-based amorphous alloys including Si, B, P, C and the like as metalloid and having nearly zero magnetostriction. However, it is possible to obtain alloys of nearly zero magnetostriction by adding a small amount of Fe to the alloy. In particular, the alloys including Si and B are preferable as metalloid. Further, metal-metal base amorphous alloys having Zn, Hf, Ta, and Nb as amorphous elements are also available. In the present invention, the magnitude of magnetostriction is an important factor, and a high permeability can be obtained particularly when the saturation magnetostriction constant lies in a range of $$\lambda_s = -2 \text{ to } 1\times10^{-6}.$$

The preferable amorphous alloy composition can be expressed as $$(Co_{1-a}Fe_a)_{100-z}(Si_{1-y}B_y)_z$$

$$0.02 \leqq a \leqq 0.08$$

$$25 \leqq z \leqq 32$$

$$0.3 \leqq y \leqq 0.5$$

where a, z and y are constants expressed by atomic ratio (z is expressed by atom %, but a and y are expressed by decimal point ratio).

In the above composition, Fe is necessary to allow the alloy to be non-magnetostrictive, and an almost non-magnetostrictive alloy can be obtained by determining the value of a between 0.02 and 0.08, preferably between 0.03 and 0.07 according to the values of z and y. The most important factor of this amorphous alloy is a compounding atomic ratio of Si to B (metalloid elements). The element B is an essential component for allowing the alloy to be amorphous. An addition of Si facilitates the change into amorphous state and improves the thermal stability. However, in order to obtain a particularly high permeability magnetic core, y indicative of the compounding atom ratio of Si to B should be restricted within a range from 0.3 to 0.5 so as to allow Si rich. This is because if y is less than 0.3 or more than 0.5, the permeability is lowered and additionally the thermal stability in the magnetic characteristics deteriorates, so that it is impossible to obtain a high permeability even when the heat treatment according to the present invention is effected.

The z indicative of the atom % of Si and B to the other should be within a range from 25 to 32. This is because if z is less than 25, high permeability is not obtained at a low frequency range, and additionally the thermal stability deteriorates in particular. On the other hand, if z exceeds 32, the Curie temperature is lowered out of the practical use and the heat treatment according to the present invention is not effective.

Further, in order to improve the corrosion resistance and the thermal stability of these amorphous alloys, it is effective to add Ti, V, Cr, Mn, Ni, Cu, Zr, Nb, Mo, Hf, Ta, W and a platinum group element so as to substitute Co with these elements. These elements can be added until the Curie temperature of the amorphous alloy reaches the lower limit of the practical temperatures. For instance, the metal can be added up to about 8 atom % (or 0.08) but below about 4 atom % in practice.

The above alloys can be expressed in combination with the afore-mentioned amorphous alloy composition as follows:

$$(Co_{1-a-b}Fe_aM_b)_{100-z}(Si_{1-y}B_y)_z$$

where M is at least one of Ti, V, Cr, Mn, Ni, Cu, Zr, Nb, Mo, Hf, Ta, W and a platinum group metal, and other constants expressed by atomic ratio are $$0.02 \leqq a \leqq 0.08$$

$$0 \leqq b \leqq 0.04$$

$$0.3 \leqq y \leqq 0.5$$

$$25 \leqq z \leqq 32.$$

Further, when Mn is selected as M component, it is possible to eliminate Fe when Mn is more than 6 atom %.

The amorphous alloys of the present invention can readily be manufactured by the conventional rapid quenching method (e.g. single roll technique) such that an alloy material with predetermined composition ratios is quenched from the melted condition at a cooling speed higher than $10^4$° C./sec.

This amorphous alloy is formed into a ribbon in accordance with a single roller method (a melted alloy is poured onto a rotating roller to obtain a ribbon). The thickness of the ribbon should preferably be determined between 5 and 25 μm, because it is practically impossible to manufacture a ribbon with a thickness less than 5 μm and the deterioration in permeability due to eddy current increases at a high frequency range if the thickness exceeds 25 μm.

Figure 2:
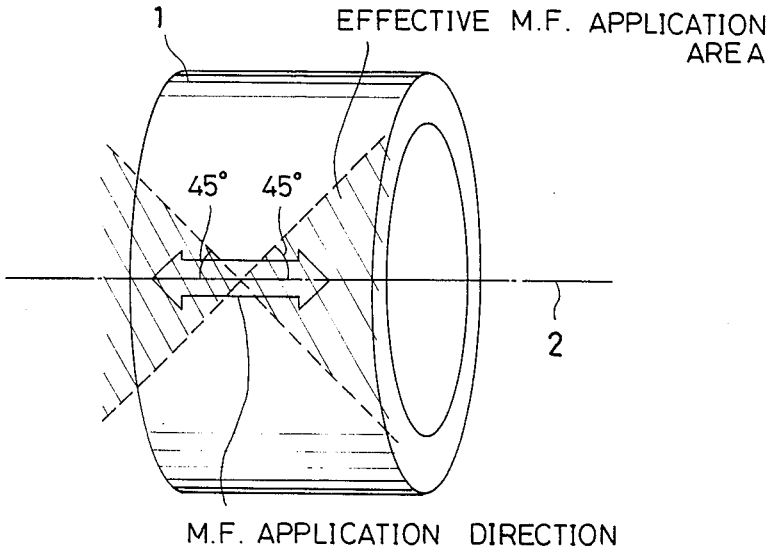
FIG. 2 is a perspective view showing a magnetic core to be heat-treated within a magnetic field.

The amorphous alloy ribbon thus obtained is wound or laminated into a magnetic core shape as shown in FIG. 2, heat-treated to eliminate stress and cooled at a cooling speed from 0.5 to 50° C./min. This is because if the cooling speed is lower than 0.5° C./min or higher than 50° C./min, the permeability is degraded. The more preferable cooling speed range lies between 1 and 20° C./min.

The magnetic core thus manufactured is heat treated within a magnetic field. More specifically, in the heat treatment within a magnetic field according to the present invention, a magnetic field is applied, particular, transverse to the ribbon axis constituting a magnetic core. FIG. 2 illustrates this magnetic field application direction. A magnetic field is applied in the transverse direction 2 of a magnetic core 1 formed by winding the amorphous alloy ribbon. The allowable inclination range of the magnetic field application is about ±45 degrees from the direction 2. This heat treatment within a magnetic field can continuously be effected immediately after stress relief heat treatment or can be effected by cooling the core once and heat it again for the heat treatment. In other words, a magnetic field can initially be applied to the core when the core is first heat-treated within a magnetic field or continuously be applied thereto from when the stress relief heat treatment is being effected.

The heat treatment temperature is below the Curie temperature, but preferably higher than 180° C. for providing a more effective heat treatment effect. The heat treatment atmosphere is not specified; that is, any of an inert gas such as $N_2$, Ar, etc., a vacuum, a deoxidizing atmosphere, and the air are available.

The heat treatment time is preferably 10 min or more. It is unnecessary to maintain the core at a constant temperature. The heat treatment is satisfactory when the core is maintained at a temperature higher than 100° C. for about 10 min to 3 hours. The cooling speed after the heat treatment is not specified, but preferably lies between 0.1 and 100° C./min. The intensity of the magnetic field to be applied is 1 Oe or more, but preferably 10 Oe or more.

Some examples of the present invention will be described hereinbelow:

EXAMPLE 1

Various Co-based amorphous alloys having a saturation magnetostriction constant ($\lambda s \leqq 1 \times 10^{-6}$) were prepared by adjusting the composition ratio of (Co-Fe) and (Si-B) to obtain various materials having different Curie temperatures (Tc). The materials were wound into a magnetic core. The amorphous alloy thin ribbon was 5 mm in width and 18 μm in thickness. The magnetic core was 20 mm in outer diameter and 14 mm in inner diameter.

After the stress relief heat treatment, these magnetic cores were heat treated at temperature of (Tc-20)° C. for about 45 to 60 min while applying a magnetic field of 200 Oe in the direction of the width of the ribbon and thereafter cooled at a cooling speed of 3° C./min.

Figure 3:
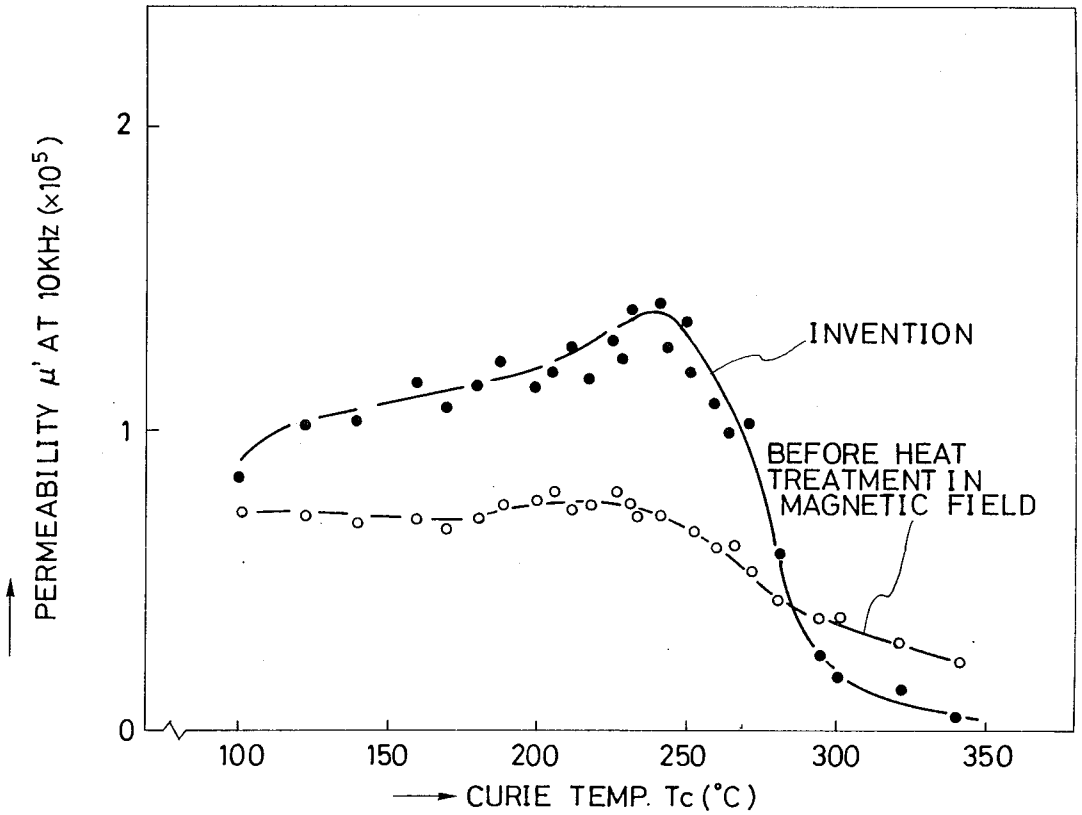
FIG. 3 is a graphical representation showing the relationship between Curie temperature and permeability for indicating the effect of the heat treatment within a magnetic field according to the present invention.

FIG. 3 shows the relationship between the Curie Temperature Tc (°C.) and the permeability μ' at 10 kHz when an exciting field of 2 mOe is applied to the cores. This graphic indicates that the permeability increases markedly when Tc lies between 120 and 270° C. The above μ' indicates a real part of a complex permeability obtained in an alternating magnetic field (at 10 kHz).

EXAMPLE 2

Various amorphous alloys having the compositions as shown in Table 1 were prepared and formed into the same core as for in Example 1. After the stress relief heat treatment, the heat treatment within a magnetic field was effected at temperature below Tc for about 30 min by applying a magnetic field of 50 Oe transverse to the ribbon axis. The permeability μ' at 10 kHz within a magnetic field of 2 mOe is also shown.

This table indicats that the permeability is fairly high in when the compounding ratio of Si is relatively large.

In table 1, Sample No. 27 is an alloy having a Curie temperature of 320° C. (beyond the upper limit of 270° C. of the present invention) for comparison. In this Sample No. 27, since the Curie temperature is high, the permeability μ' is low before and after heat treatment (μ' is further reduced after the heat treatment).

TABLE 1

| Sample No. | COMPOSITION | Tc (°C.) | H.T. temp. (°C.) | (μ'10 kHz) × $10^5$ Before H.T. | After H.T. |
|---|---|---|---|---|---|
| 1 | $(Co_{0.93}Fe_{0.07})_{71}Si_{15}B_{14}$ | 250 | 230 | 0.520 | 1.08 |
| 2 | $(Co_{0.96}Fe_{0.04})_{71}Si_{15}B_{14}$ | 234 | 220 | 0.550 | 1.25 |
| 3 | $(Co_{0.95}Fe_{0.05})_{72}Si_{19}B_{9}$ | 235 | 215 | 0.548 | 1.20 |
| 4 | $(Co_{0.95}Fe_{0.05})_{70}Si_{16}B_{14}$ | 180 | 165 | 0.520 | 1.28 |
| 5 | $(Co_{0.94}Fe_{0.06})_{69}Si_{12}B_{19}$ | 248 | 225 | 0.472 | 0.97 |
| 6 | $(Co_{0.95}Fe_{0.05})_{69}Si_{19}B_{12}$ | 120 | 100 | 0.498 | 0.95 |
| 7 | $(Co_{0.93}Fe_{0.07})_{70}Si_{13}B_{17}$ | 252 | 230 | 0.458 | 0.94 |
| 8 | $(Co_{0.96}Fe_{0.04})_{70}Si_{18}B_{12}$ | 162 | 145 | 0.500 | 1.02 |
| 9 | $(Co_{0.93}Fe_{0.05}V_{0.02})_{72}Si_{16}B_{12}$ | 242 | 220 | 0.572 | 1.24 |
| 10 | $(Co_{0.93}Fe_{0.05}Cr_{0.02})_{72}Si_{16}B_{12}$ | 240 | 220 | 0.528 | 1.22 |
| 11 | $(Co_{0.93}Fe_{0.05}Ni_{0.02})_{71}Si_{15}B_{14}$ | 230 | 215 | 0.525 | 1.19 |
| 12 | $(Co_{0.93}Fe_{0.05}Cr_{0.02})_{72}Si_{15}B_{13}$ | 245 | 225 | 0.521 | 1.20 |
| 13 | $(Co_{0.93}Fe_{0.05}Nb_{0.02})_{72}Si_{17}B_{11}$ | 229 | 210 | 0.542 | 1.05 |
| 14 | $(Co_{0.91}Fe_{0.05}Nb_{0.04})_{72}Si_{17}B_{11}$ | 191 | 170 | 0.535 | 1.13 |
| 15 | $(Co_{0.93}Fe_{0.05}Mn_{0.02})_{71}Si_{16}B_{13}$ | 238 | 215 | 0.552 | 1.19 |
| 16 | $(Co_{0.93}Fe_{0.05}Mo_{0.02})_{72}Si_{15}B_{13}$ | 244 | 220 | 0.565 | 1.24 |
| 17 | $(Co_{0.90}Fe_{0.05}Mo_{0.05})_{72}Si_{15}B_{13}$ | 204 | 180 | 0.558 | 1.28 |
| 18 | $(Co_{0.93}Fe_{0.05}Ta_{0.02})_{72}Si_{14}B_{14}$ | 248 | 230 | 0.562 | 1.11 |
| 19 | $(Co_{0.91}Fe_{0.05}Ta_{0.04})_{71}Si_{15}B_{14}$ | 168 | 150 | 0.530 | 1.18 |
| 20 | $(Co_{0.93}Fe_{0.05}W_{0.02})_{72}Si_{14}B_{14}$ | 253 | 240 | 0.538 | 1.09 |
| 21 | $(Co_{0.90}Fe_{0.05}W_{0.05})_{71}Si_{15}B_{14}$ | 148 | 135 | 0.510 | 1.10 |
| 22 | $(Co_{0.92}Fe_{0.04}Ti_{0.02}Cr_{0.02})_{72.5}Si_{15}B_{12.5}$ | 242 | 225 | 0.555 | 1.15 |
| 23 | $(Co_{0.92}Fe_{0.05}Nb_{0.02}Ni_{0.02})_{73}Si_{16}B_{11}$ | 250 | 230 | 0.538 | 1.10 |
| 24 | $(Co_{0.92}Fe_{0.05}Hf_{0.03})_{72}Si_{15}B_{13}$ | 235 | 215 | 0.545 | 1.13 |
| 25 | $(Co_{0.92}Fe_{0.05}Zr_{0.03})_{72}Si_{15}B_{13}$ | 233 | 215 | 0.532 | 1.10 |
| 26 | $(Co_{0.93}Fe_{0.07}Ti_{0.02})_{71}Si_{12}B_{17}$ | 247 | 230 | 0.460 | 0.94 |

TABLE 1-continued

| Sample No. | COMPOSITION | Tc (°C.) | H.T. temp. (°C.) | ($\mu$'10 kHz) × $10^5$ Before H.T. | After H.T. |
|---|---|---|---|---|---|
| 27 | $(Co_{0.93}Fe_{0.07})_{73}Si_{10}B_{17}$(For comparison) | 320 | 250 | 0.280 | 0.15 |

EXAMPLE 3

Various amorphous alloys having the compositions as shown in Table 2 were prepared and formed into the same core as in the Example 1. After the stress relief heat treatment, the heat treatment within a magnetic field was effected at temperature below Tc for about 30 min by applying a magnetic field of 50 Oe in the transverse direction of the ribbon. The saturation magnetostriction constant ($\lambda s$) shown in Table 2 was measured by a strain gage. When the constant is not sensible by the gage, the sign of the constant was determined on the basis of the change in hysteresis curve caused when a stress is applied to the ribbon. This table shows the permeability $\mu'$ at 10 kHz obtained when the measuring magnetic field is 2 mOe. This table indicates that the effect of the heat treatment within a magnetic field applied to the lateral direction of the ribbon is very prominent when the saturation magnetostriction constant $\lambda s$ of the amorphous alloy is from $-2$ to $1\times10^{-6}$. That is, the permeability $\mu'$ is low in the case of Sample Nos. 6 and 7 ($\lambda_s=+2$ or $-2.5$).

TABLE 2

| Sample No. | COMPOSITION | $\lambda_s$ ($\times 10^{-6}$) | Tc (°C.) | H.T. temp. (°C.) | ($\mu$'10 kHz) × $10^5$ Before H.T. | After H.T. |
|---|---|---|---|---|---|---|
| 1 | $(Co_{0.93}Fe_{0.07})_{71}Si_{15}B_{14}$ | 1 | 250 | 230 | 0.52 | 1.08 |
| 2 | $(Co_{0.94}Fe_{0.06})_{71}Si_{15}B_{14}$ | Less than +1 | 243 | 220 | 0.52 | 1.48 |
| 3 | $(Co_{0.95}Fe_{0.05})_{71}Si_{15}B_{14}$ | 0 | 238 | 220 | 0.55 | 1.39 |
| 4 | $(Co_{0.96}Fe_{0.04})_{71}Si_{15}B_{14}$ | More than −1 | 234 | 220 | 0.55 | 1.25 |
| 5 | $(Co_{0.97}Fe_{0.03})_{72}Si_{16}B_{12}$ | −1 | 249 | 235 | 0.53 | 1.22 |
| 6 | $(Co_{0.90}Fe_{0.10})_{70}Si_{14}B_{16}$ | +2 | 250 | 235 | 0.24 | 0.29 |
| 7 | $(Co_{0.99}Fe_{0.01})_{71}Si_{13}B_{16}$ | −2.5 | 242 | 220 | 0.28 | 0.38 |

EXAMPLE 4

An amorphous alloy having a composition as $(Co_{0.94}Fe_{0.06})_{71}Si_{11}B_{12}$ (Tc=230° C.) was formed into a core and heat treated within a magnetic field the same as in Example 1.

A common mode choke coil was made by using a magnetic core of the above alloy, and assembled with a switching power supply to measure the noise reduction effect. The switching frequency was 40 kHz. The noise reduction effect was measured at 40, 80 and 120 kHz (including higher harmonics). Further, an alloy of $(Co_{0.94}Fe_{0.06})_{71}Si_5B_{24}$ (Tc=340° C. higher than the upper limit) heat treated under the same condition as in Example 1 (Comparison 1) and a ferrite (Comparison 2) were formed into the same magnetic cores and measured for comparison with this Example 4. The measured results are shown in Table 3. This table 3 indicates that Example 4 is excellent in noise reduction effect as compared with Comparisons 1 or 2.

TABLE 3

| f(kHz) | Example 4 | (Comparison 1 | Comparison 2 |
|---|---|---|---|
| 40 | −68.5 (dB) | −53.80 (dB) | −52.0 (dB) |
| 80 | −79.8 | −68.6 | −70.0 |
| 120 | −80.9 | −70.5 | −73.1 |

Figure 4:
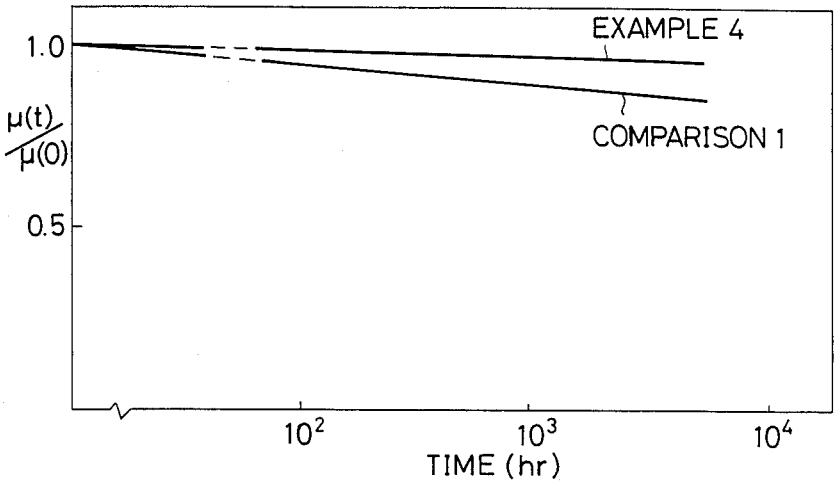
FIG. 4 is a graphical representation showing the aging characteristics of permeability of the material manufactured by the method according to the present invention.

FIG. 4 shows the aging characteristics of the effective permeability $\mu(t)$ at 10 kHz and 120° C. when the initial value $\mu_0$ is 1.0. For comparison, both of Example 4, and Comparison 1 are shown. This graph indicates that Example 4 is superior to Comparison 1 with respect to the 120° C. aging characteristics.

Two common mode chokes were made of the same alloys (Example 4 and Comparison 1) and assembled in a switching power supply for measurement. The noise level variations of both in the passage of time were almost the same as shown in FIG. 4. A noise filter made of the alloy according to the present invention was stable in noise level variation.

Further, in Example 4, the permeability was about $0.65\times10^5$ at 10 kHz before heat treatment in magnetic field, and about $1.31\times10^5$ after the same heat treatment. Further, it has been confirmed that the high permeability of the magnetic core was kept for a long term.

What is claimed is:

1. A heat treated, high permeability magnetic material in the form of a ribbon having a thickness of 5 to 25 $\mu$m consisting essentially of a Co-based amorphous alloy with a Curie temperature Tc of 120° C.≦Tc≦270° C., wherein said material has been heat treated to increase the permeability of said material by heating at a temperature below the Curie temperature and within a magnetic field applied transverse to the axis of said ribbon, and wherein said Co-based amorphous alloy is expressed as $$(Co_{1-a}Fe_a)_{100-z}(Si_{1-y}B_y)_z$$

$$0.02\leqq a\leqq 0.08$$

$$0.3\leqq y\leqq 0.5$$

$$25\leqq z\leqq 32$$

where a, y and z are constants expressed by atomic ratio.

2. The magnetic material as set forth in claim 1, wherein the Curie temperature Tc of said amphorous alloy is 220° C.≦Tc≦250° C.

3. The magnetic material as set forth in claim 1, wherein the saturation magnetostriction constant λs of said Co-based amorphous alloy is $$-2\times10^{-6}\leqq\lambda_s\leqq1\times10^{-6}.$$

4. The magnetic material as set forth in claim 1, wherein the intensity of the applied magnetic field is 1 Oe or more.

5. The magnetic material as set forth in claim 4, wherein the intensity of the applied magnetic field is preferably 10 Oe or more.

6. The magnetic material as set forth in claim 1, wherein the magnetic material is used for a noise filter.

7. A heat treated, high permeability magnetic material in the form of a ribbon having a thickness of 5 to 25 μm consisting essentially of a Co-based amorphous alloy with a Curie temperature Tc of 120° C.≦Tc≦270° C., wherein said material has been heat treated to increase the permeability of said material by heating at a temperature below the Curie temperature and within a magnetic field applied transverse to the axis of said ribbon and wherein said Co-based amorphous alloy is expressed as $$(Co_{1-a-b}Fe_aM_b)_{100-z}(Si_{1-y}B_y)_z$$

where M denotes at least one of Ti, V, Cr, Mn, Ni, Cu, Zer, Nb, Mo, Hf, Ta, W and a platinum group metal, and a, b, y and z are constats expressed by atomic ratio by $$0.02\leqq a\leqq0.08$$

$$0\leqq b\leqq0.04$$

$$0.3\leqq y\leqq0.5$$

$$25\leqq z\leqq32.$$

* * * * *